US005158241A

United States Patent [19]

Dammann et al.

[11] Patent Number: 5,158,241

[45] Date of Patent: Oct. 27, 1992

[54] APPARATUS FOR CUTTING AN ADVANCING YARN

[75] Inventors: Peter Dammann, Remscheid; Klaus Bartkowiak, Herne, both of Fed. Rep. of Germany

[73] Assignee: Barmag AG, Remscheid, Fed. Rep. of Germany

[21] Appl. No.: 565,814

[22] Filed: Aug. 10, 1990

Related U.S. Application Data

[63] Continuation-in-part of Ser. No. 503,319, Apr. 2, 1990, Pat. No. 5,107,668.

[30] Foreign Application Priority Data

Jun. 19, 1989 [DE] Fed. Rep. of Germany ..... 3919855
Nov. 2, 1989 [DE] Fed. Rep. of Germany ..... 3936486
Feb. 23, 1990 [DE] Fed. Rep. of Germany ..... 4005821

[51] Int. Cl.[5] ..... B65H 75/32; B65H 54/02
[52] U.S. Cl. ..... 242/18.0 PW; 242/19
[58] Field of Search ..... 242/18 PW:19

[56] References Cited

U.S. PATENT DOCUMENTS

| | | | |
|---|---|---|---|
| 3,155,331 | 11/1964 | Pitts | 242/19 X |
| 3,162,388 | 12/1964 | Balash | 242/19 X |
| 3,224,692 | 12/1965 | Nugent | 242/19 |
| 3,347,476 | 10/1967 | O'Brien | 242/19 |
| 3,472,108 | 10/1969 | Vandersip | 242/19 |
| 3,526,348 | 4/1968 | Morrocco et al. | 242/19 |
| 3,767,130 | 10/1973 | Perrino | 242/18 PW |
| 3,908,918 | 9/1975 | Bergstrom | 242/19 |
| 3,942,732 | 3/1976 | Adamson | 242/19 |
| 4,106,711 | 8/1978 | Oswald et al. | 242/19 |
| 4,451,007 | 5/1984 | Ohkubo et al. | 242/18 PW |
| 4,617,791 | 10/1986 | Lousberg | 242/18 PW |

FOREIGN PATENT DOCUMENTS

| | | | |
|---|---|---|---|
| 7126191 | 7/1971 | Fed. Rep. of Germany . | |
| 7325026 | 6/1973 | Fed. Rep. of Germany . | |
| 2352435 | 4/1975 | Fed. Rep. of Germany | 242/19 |
| 2536477 | 7/1976 | Fed. Rep. of Germany | 242/18 PW |
| 3516522 | 11/1985 | Fed. Rep. of Germany | 242/19 |
| 3710692 | 10/1988 | Fed. Rep. of Germany . | |
| 332263 | 8/1976 | Switzerland . | |

*Primary Examiner*—Daniel P. Stodola
*Assistant Examiner*—William Stryjewski
*Attorney, Agent, or Firm*—Bell, Seltzer, Park & Gibson

[57] ABSTRACT

An apparatus for cutting an advancing yarn which comprises a cutting blade which is oriented with respect to the advancing yarn, such that when the advancing yarn and blade are moved into engagement, the yarn is deflected from its path of travel to increase its tension, and the yarn moves along the cutting edge of the blade with no substantial component of movement transverse to the cutting edge. The yarn is thus cleanly cut at a single point along its length, in the same manner as a stationary yarn is cut by hand with a knife.

8 Claims, 2 Drawing Sheets

APPARATUS FOR CUTTING AN ADVANCING YARN

REFERENCE TO RELATED APPLICATIONS

This is a continuation-in-part of copending application Ser. No. 07/503,319, filed Apr. 2, 1990, now U.S. Pat. No. 5,107,668 the disclosure of which is expressly incorporated herein by reference.

BACKGROUND OF THE INVENTION

The present invention relates to an apparatus for cutting an advancing yarn during the thread-up procedure of a yarn winding operation.

Yarn cutting devices are known, for example from the German Utility Model 73 23 026, German Utility Model 71 26 191, and German Patent 35 16 522. All these cutting devices have the disadvantage that it is necessary to carry out a cut very quickly, if it is to be successful, and in each instance, there exists the risk that the cut yarn end breaks open, so that is can no longer be located, and/or that the individual filaments enter into machine parts.

It is the object of the present invention to design and construct a cutting apparatus for an advancing yarn in such a manner that the yarn can be cut at any desired speed and without incurring the risk of opened yarn ends. Likewise, it is an object that the cutting operation proceed substantially independently of the yarn tension and particularly without peaks in the tensile force.

SUMMARY OF THE INVENTION

The above and other objects and advantages of the present invention are achieved in the embodiments illustrated herein by the provision of an apparatus which comprises means for advancing a yarn along a path of travel, a yarn cutting blade having a straight cutting edge, means for relatively moving the yarn and cutting blade in a direction transverse to the direction of advance of the yarn and such that the cutting edge contacts the yarn, and with the cutting blade being oriented such that that upon contact with the cutting edge, the yarn is deflected from its path of travel and moves along the cutting edge with no substantial component of movement transverse to the cutting edge.

By this construction, the advancing yarn may be cleanly cut at a single point along its length. In other words, the yarn is cut in the same manner as a stationary yarn is cut by hand with a knife. A feature of the invention is that a relative movement transverse to the yarn axis is added to the movement of the yarn along its axis. This relative movement can be produced on the one hand in that the yarn is additionally moved transversely to its axis, as is the case, for example, in the traversing triangle of a yarn advancing to a traversing system. Consequently, the cutting device will be especially suitable for cutting a yarn advancing to a full package. However, the relative movement transverse to the yarn axis can also be produced by having the cutting device perform a movement transverse to the yarn axis.

The latter situation exists for example when a yarn is caught in a clamping plate which supports one end of a tubular yarn bobbin, such as is described in German Patent 35 16 522. Thus the cutting device of the present invention may be substituted for the cutting device described in the referenced patent.

The invention will be described hereinbelow with reference to two embodiments, one being a device for cutting a yarn advancing to a full package, and the other a cutting device arranged on a clamping plate which is adapted to support one end of a tubular yarn bobbin.

BRIEF DESCRIPTION OF THE DRAWINGS

Some of the objects and advantages of the present invention having been stated, other will appear as the description proceeds, when taken in conjunction with the accompanying drawings, in which.

DETAILED DESCRIPTION OF THE PREFERRED EMBODIMENTS

Figure 1:
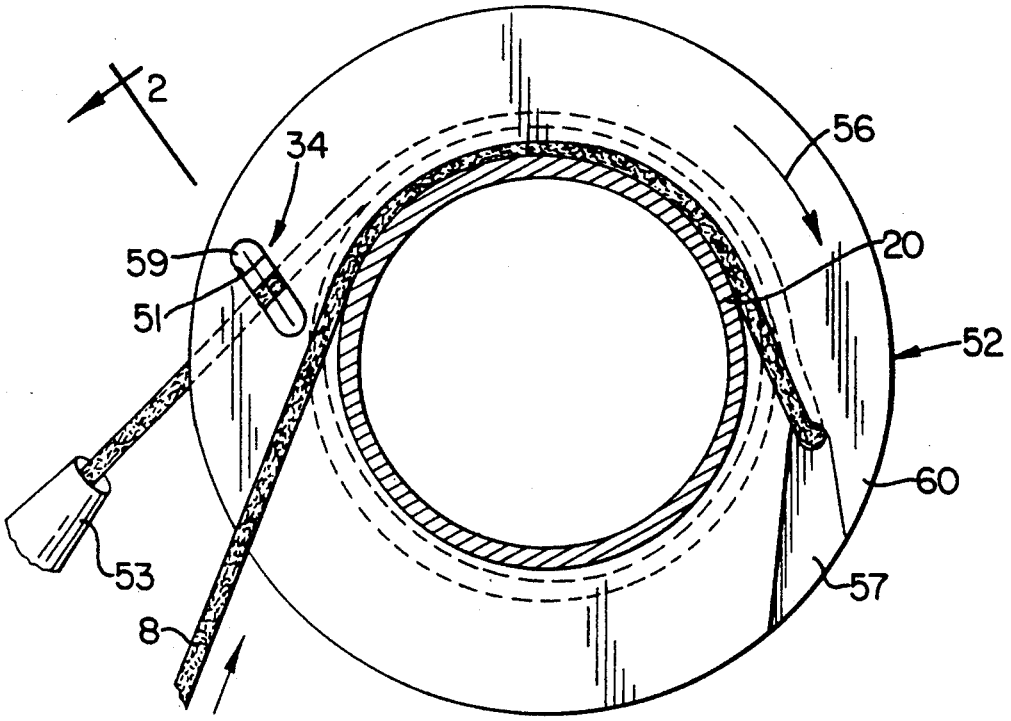
FIG. 1 is a sectional side elevation view of a clamping plate supporting one end of a tubular yarn bobbin on a yarn winding machine, and which embodies the cutting apparatus of the present invention.
Figure 2:
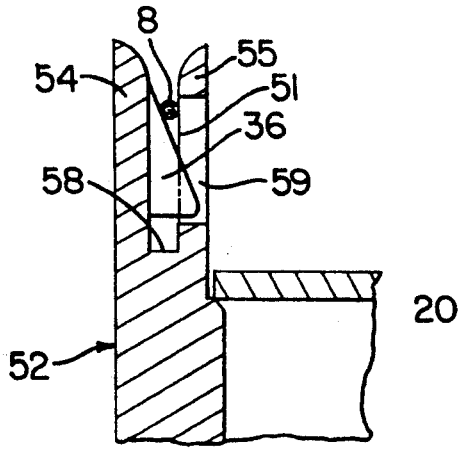
FIG. 2 is a fragmentary sectional view of the clamping plate and taken substantially along the line 2—2 of FIG. 1.
Figure 3:
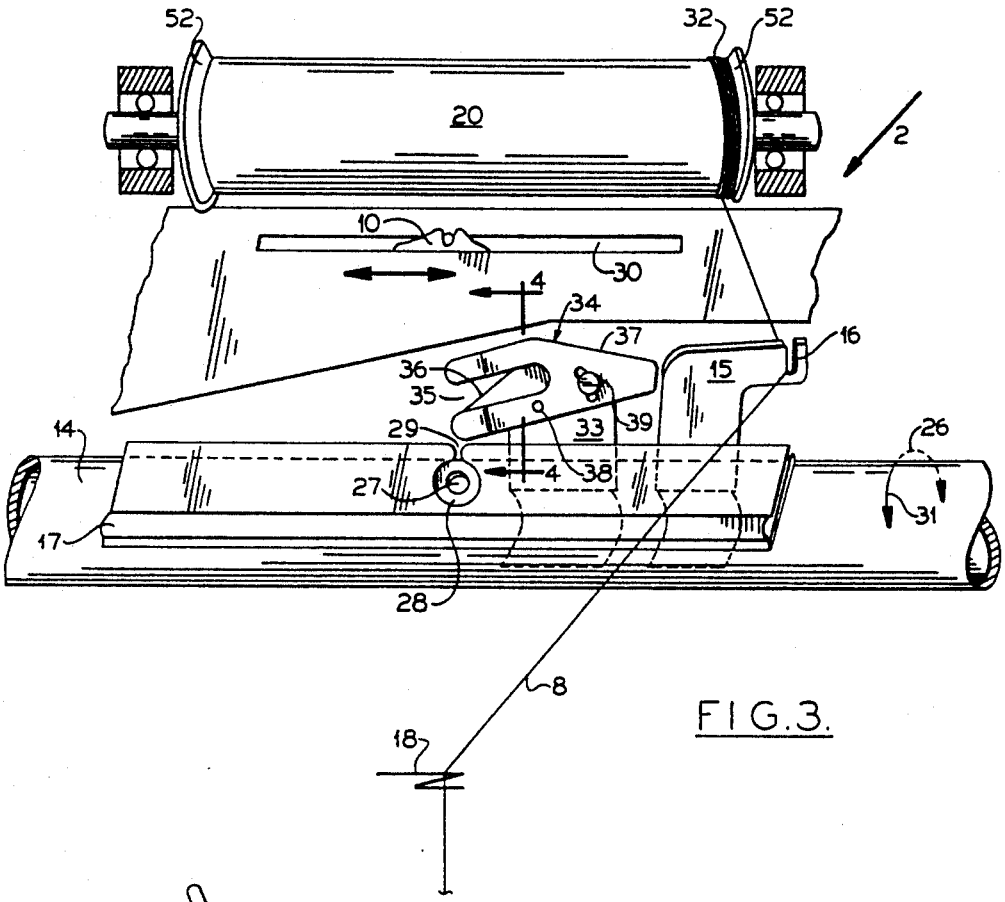
FIG. 3 is a somewhat schematic perspective view of a yarn winding apparatus and which embodies another embodiment of the present invention.

Referring more particularly to the drawings, FIGS. 1 and 2 illustrate a clamping plate 52 of the type adapted to support one end of a tubular yarn bobbin 20 on a winding machine and as further illustrated in FIG. 3. The clamping plate 52 serves to clamp the initially empty bobbin 20, and it is supported to be freely rotatable and axially displaceable. The bobbin 20 is clamped between two of such clamping plates.

The clamping plate 52 shown in FIGS. 1-2 serves also to catch an advancing yarn. The yarn is supplied by a feed system not shown here, and is withdrawn by a suction gun 53. The clamping plate comprises an annular body member having a radially directed groove about the outer circumference thereof and so as to define a pair of laterally spaced apart rims 54 and 55, and with the rims having opposing, parallel, inner surfaces. Also, the groove defines a bottom 58 formed between the two rims. The inner rim 55, which is shown in FIG. 1, is provided with a slot 57 proceeding from the outer circumference and extending generally along a chord with respect to the outer circumference. The slot 57 has a closed inner end, and a forward projection 60 which extends in the direction of rotation 56.

Diametrically opposed to the slot 57 in a direction opposite the direction of rotation 56 is a cutting device 34, which is arranged between the inner and outer rims 54 and 55. As best seen in FIG. 2, the cutting device 34 includes a wedge-shaped cutting blade 36. The cutting blade is mounted on the inner surface of the outer rim 54 and such that it enters into the groove between the inner and the outer rims 54 and 55, and forms a wedge-shaped gap toward the outer circumference of the clamping plate 52. The portion of the cutting blade which is adjacent the groove bottom 58 formed between the two rims 54, 55, projects axially into a recess 59 formed in the inner rim 55. In the illustrated embodiment, the recess 59 is in the form of a slot which extends completely through the rim 55.

Figure 5:
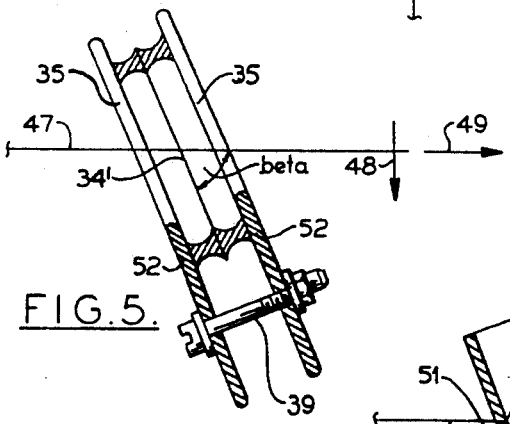
FIG. 5 is a view similar to FIG. 4 but taken in a plane perpendicular to the yarn traversing plane.
Figure 4:
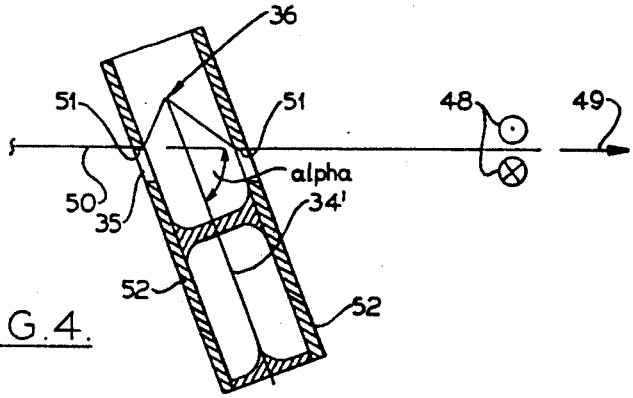
FIG. 4 is a sectional view of the yarn cutting apparatus and taken in the plane of the traversing yarn and substantially along the line 4—4 of FIG. 3.

The lateral edges 51 of the recess 59 extend parallel to the plane of the cutting blade, however, in such a manner that they are slightly spaced apart from the plane of the cutting blade. In this manner the recess 59 forms guide edges 51 on both sides of the cutting blade 36. Further, the cutting blade 36 and the lateral guide edges 51 form a wedge-shaped gap, which opens toward the outer circumference of the clamping plate 52 and narrows toward the bottom 58 of the groove formed between the rims 54 and 55. Consequently, a yarn 8, which is pulled into this wedge-shaped gap, is tensioned between the guide edges 51 and the cutting edge 36, in the same manner as shown in FIGS. 4 and 5. Furthermore, the cutting blade 36 and the guide edges 51 are so aligned that the plane of the cutting blade and the guide edges extend substantially along an involute to the bottom 58 of the groove formed between the rims 54 and 55. While this would be an ideal configuration, it will suffice, however, as can be seen in the drawing, that the extension is approximated to an involute. It will not be detrimental to the operation, that the cutting blade is straight, and thus represents the chord or tangent to an involute.

In operation, the yarn 8, which is sucked off by a suction gun 53 during the thread-up procedure, is placed with a partial looping on the empty tube 20 clamped between the two plates 52, thereby being guided over the inner rim 55 of one of the clamping plates 52. As a result, the yarn is grasped by the projection 60 of the slot 57 and drawn out to a loop composed of two yarn segments. The yarn segment leading to the suction gun 53 drops into the groove between the outer rim 54 and the inner rim 55 and partially loops about the groove bottom 58. Since the cutting device 34 is approximately 180° out of phase, as is shown in FIG. 1, relative to slot 57 against the direction of rotation 56, the yarn segment enters into the cutting device 34 after a partial looping. It should be noted that due to the friction of the looping, the yarn segment is again pulled out of the suction gun 53 and, therefore, has a direction of movement in the direction of the movement of the groove bottom 58 equal to the direction of movement 56. Since, further, the cutting edge of the blade is aligned along an involute, the relative movement between the cutting device 34 and the yarn is limited to a transverse motion with respect to the yarn. Thus, the yarn does not perform a movement perpendicular to the blade 36. As the clamping plate 52 continues to rotate, the yarn enters deeper and deeper into the wedge-shaped gap, which is formed between the cutting blade 36 and the guide edges 51. In doing so, it is laterally deflected into a V-like configuration (note FIG. 4) and more and more tensioned and finally cleanly cut, i.e., it is cut in a single axial plane of the yarn.

The design and alignment of the cutting blade according to the present invention precludes the yarn having a component of movement perpendicular to the cutting edge. Consequently, it is also avoided that the yarn will be considerably roughened and, under circumstances, assume a structure similar to the so-called edge crimping. Thus, this cutting device achieves a very defined, smooth yarn end, which is easy to locate.

FIG. 3 is a perspective view of a yarn winding unit 2, which includes a second embodiment of the invention. Absent in this illustration are the drive of the yarn traversing system as well as the friction roll necessary to drive the package, which are well known in the art. As illustrated, the winding unit includes a pair of clamping plates 52, which are mounted to freely rotate, and which mount a bobbin 20 coaxially therebetween. A horizontal suction tube 14 is mounted upstream of the bobbin 20, and the tube is selectively rotatable as indicated by the arrows 26 and 31 between an inoperative position and an operative position respectively. A yarn guide arm 15 and a holder 33 for a cutting blade assembly 34, are mounted to the tube as further described below.

FIG. 3 shows the apparatus during the thread-up procedure, with the yarn 8 having been wound on the bobbin 20, and in which the yarn advances to the rotated winding bobbin 20 at a relatively slow or crawl speed, and before it is again engaged with a traversing system 10. To this end, the yarn 8 is guided to the empty bobbin 20 outside the traversing range by a guide fork 16 on the arm 15. The traversing range is predetermined by the length of the slot 30 of a yarn guide or respectively the yarn traversing system 10. A suction opening necessary to remove the cut yarn is formed by a radial jacket opening 27 in the suction tube 14. A deflection bar 17 is also mounted on the tube 14 and is provided with a recess 28 which is radially aligned over the jacket opening, and which recess opens in the shape of a slot 29 in the direction toward the winding bobbin 20. The recess surrounds the jacket opening with a spacing therebetween. This slot-shaped opening serves the purpose of catching the yarn traversing from the left in the recess, so that it continues to move in the catching area of the suction opening 27 irrespective of its further traversing motion. As a result, it is necessary that the effective catching area of the suction opening 27 be at least as large as the area of the recess 28 in the deflecting rail.

At the end of a winding cycle, which is not illustrated, the suction tube 14 is rotated in the opposite direction 31, so as to initiate the end of the traversing motion. In this regard, the cutting blade assembly 34, which is attached to a holder 33, is rigidly connected with the suction tube 14. The details of the construction of such a cutting blade and holder are illustrated in FIGS. 4 and 5.

The cutting blade assembly is provided with a slot 35 extending in the traversing plane, into which the yarn enters from the left. The slot is overlapped in wedge shape by the cutting edge 36 of a flat cutting blade and, thus, narrows for the yarn entering thereinto. Due to the narrowing, the yarn is pressed against the cutting edge, thereby increasing its tension, and as a result, the yarn is reliably cut. Since the yarn advancing from the left is also caught by the slot 29 of the recess 28, it is bound to have its cut end in the catching area of the suction opening 27 and it is consequently removed by the suction tube 14 after having been cut. One special feature of the illustrated embodiment is that the cutting blade assembly 34 is provided with only one slot, so that the yarn is traversed into same always from one direction. For this reason, the cutting blade assembly is provided at its end facing away from the slot with a guide edge 37, which extends obliquely through the traversing plane and points substantially in the traversing direction. The yarn passes unhindered over the guide edge as long as it is traversed only from the right to the left. During the following traverse stroke from the left to the right the yarn is then traversed into the slot 35 and cut. Another special feature is that the slot 35 approaches the winding bobbin from its opening to its end, i.e. the end of the slot 35 is closer to the bobbin 20 than is the entry of the slot.

Yet another special feature is that the cutting blade assembly 34 is adapted for rotation about the axis of a pin 38 provided in the holder 33 such that its rear end can be raised or lowered with respect to the traversing plane. The angle between the traversing plane and the slot 35 determines the inclination of the cutting blade. A clamping bolt 39, which is guided in a circular slot with respect to the axis of pin 38, serves for a precise rotational adjustment of the inclination or oblique position. Due to the deflection of the slot end toward the package, an irreversible clamping effect of the narrowing slot and, thus, a reliable cutting of the yarn are produced, since the yarn traversing thereinto undergoes a tensioning. The inclination or oblique position effects an additional tensioning of the yarn during its passage over the blade edge 36, since the yarn is automatically raised under its tension from the traversing plane until it is cut.

FIGS. 4 and 5 are detail views of the construction of a cutting blade assembly 34, and which comprises a pair of spaced apart plates 52 mounting a blade 34' therebetween. As shown in FIG. 4, the cutting blade assembly 34 is inclined in such a manner that the angle between the plane of the cutting blade 34' and the traversing plane does not amount to 90°. This angle is indicated at "alpha." The plane of the cutting blade 34' is so inclined that the cutting edge 36 is directed against the arriving yarn. Accordingly, the angle alpha, which is less than 90°, is located behind the plane of the cutting blade.

FIG. 5 is a top view of the assembly 34 and taken in the plane of the slot 35. The plates 52 are inclined toward the center line of the traversing triangle 47. With respect to the center line of the traversing triangle, the plates 52 are rotated such that the cutting edge approaches the winding bobbin from its beginning to its end. Accordingly, the angle beta, which is formed by the cutting edge with the center line of the traversing triangle is behind the cutting edge and smaller than 90°, when viewed in the direction of the advancing yarn. As illustrated in FIG. 5, the yarn is traversed in direction 48 transversely across the cutting edge as it enters into the slot 35.

In deviation thereof, FIG. 4 is a side view of the traversing plane 50 and the directions of the traverse 48 are each perpendicular to the plane of the cutting blade. The direction of the advancing yarn is indicated at 49.

The following applies to both FIGS. 4 and 5. The cutting blade 34' is attached to the plates 52. The plates 52 and the blade 34, are not in surface contact, but have a space therebetween, which prevents the yarn from being clamped, and yarn remnants and lint from accumulating.

In operation, the yarn pulls itself, while locking under its own action, into the narrowing portion of the slot 35 due to its traversing motion and so that only a single point of the yarn slides along the edge 36 of the cutting blade. To achieve this result, the generally straight cutting edge 36 is disposed along a line which obliquely intersects the traversing plane, and which is also aligned along the resultant of the advancing movement 49 of the yarn and the lateral reciprocating movement 48 of the yarn when viewed in direction perpendicular to the traversing plane, i.e. FIG. 5.

The cutting edge 36 extends obliquely through the traversing plane, so that the yarn is removed further from the traversing plane as its passes over the cutting edge. It is pulled by the cutting edge 36 under the guide edges 51 and additionally tensioned. This accomplishes that the looping angle of the yarn further increases on the cutting edge 36, whereby the frictional forces continue to increase between the yarn and the looped cutting edge. This continues until the yarn is cut. Due the increasing frictional force, which the looped cutting edge exerts on the yarn, the tension of the yarn which continues to be wound, increases, which also favors the cutting process.

The cutting principle, which is realized by the cutting blade, consists in that the cutting edge is so aligned that the yarn or a single point of the yarn, which contacts the cutting edge, does not perform a relative movement transverse to the cutting edge. The principle further includes that during its passage over the cutting edge, the yarn is guided into a wedge-shaped slot or gap, which is formed by the cutting edge with guide edges extending in front of and/or behind the plane of the cutting blade. As a result, the yarn is tensioned between the guide edges on the one hand and the cutting edge on the other to an increasing extent so that the yarn forms on the cutting edge a V-like angle, which preferably becomes more and more acute.

Thus, the cutting blade is equipped and arranged in such a manner that the cutting process corresponds entirely to the way in which a yarn is normally cut with a knife, in that it may be cleanly cut at a single point along the length of the yarn.

In the drawings and specification, there has been set forth a preferred embodiment of the invention, and although specific terms are employed, they are used in a generic and descriptive sense only and not for purposes of limitation.

The which is claimed is:

1. An apparatus for cutting a moving yarn, comprising:

means for moving said yarn along its length direction to define a predetermined path;

cutting blade means and comprising a cutting edge;

means for relatively moving said yarn and cutting blade means in a direction transversely of said other, said cutting edge of said cutting blade means being of generally straight configuration and disposed along a line which obliquely intersects said transverse movement, and said cutting edge being aligned along the resultant of the movement of said yard and said relative transverse movement when viewed in a direction perpendicular to the plane of said transverse movement, such that said yarn engages said cutting edge and is cut by said cutting edge with said yarn having no substantial component of movement transverse of said cutting edge, and said yarn may be cleanly cut at a single point along its length.

2. An apparatus for cutting a moving yarn, comprising:

means for moving said yarn along a predetermined path and laterally reciprocating said yarn to define a traversing plane;

cutting blade means comprising a cutting edge;

means for selectively moving said cutting blade means into an orientation with said cutting edge intersecting said traversing plane, said cutting edge of said cutting blade means being of generally straight configuration and disposed along a line obliquely intersects said traversing plane, and when in said orientation said cutting edge is aligned along the resultant of the movement of said yarn and said reciprocating movement of said yarn when viewed in a direction perpendicular to said traversing plane, and such that said yarn, when reciprocating toward said blade, is cut by contact with said cutting edge with no substantial component of movement transverse of said cutting edge, and said moving yarn is cleanly cut at a single point along its length.

3. The apparatus as defined in claim 2, wherein said cutting blade means defines a cutting plane, and wherein said means for selectively moving said cutting blade means comprises holder means including guide edge means which is disposed in a plane parallel to the plane of said cutting blade means and spaced laterally therefrom, said guide edge means, when viewed in a direction perpendicular to said plane of said cutting blade means, crossing said cutting edge means and forming a wedge-shaped gap therewith which closes in the direction of yarn movement toward said cutting blade means.

4. A yard winding apparatus comprising:

means for rotatably mounting a tubular yarn bobbin;

drive means for rotating said yarn bobbin to move the yarn along a predetermined path and form a yarn package thereon;

yarn traversing means for reciprocating a moving yarn to form a cross-wound package on said rotating bobbin, said reciprocating yarn defining a traversing plane, yarn cutting blade means comprising cutting edge means of generally straight configuration;

means for mounting said cutting blade means for selective movement between an inoperative position spaced from said traversing plane and an operative position wherein said blade means is in a predetermined orientation intersecting said traversing plane and wherein, when said cutting blade means is in said operative position, said cutting edge means is disposed along a line which obliquely intersects said traversing plane, and wherein said cutting edge means is also aligned along the resultant of the predetermined path and the reciprocating movement of the yarn when viewed in a direction perpendicular to said traversing plane, whereby said yarn, when reciprocating toward said blade means, is cut by contact with said cutting edge means with no substantial component of movement traverse of said cutting edge means, and said yarn is cleanly cut at a single point along its length.

5. A clamping plate adapted for supporting one end of a tubular yarn bobbin during a yarn winding operation, and having provisions for severing the yarn during a yard thread-up procedure, comprising:

an annular body member having a radially directed groove about the outer circumference thereof so as to define a pair of laterally spaced apart rims, said rims having opposing, parallel, inner surfaces, and yarn cutting blade means mounted on one of said inner surfaces and so as to extend into said groove, said cutting blade means having cutting edge means substantially aligned along an involute to the bottom of said groove, such that an advancing yarn may be positioned in said groove while said clamping plate is rotated with said yarn bobbin such that said yarn is cleanly cut at a single point along its length.

6. The clamping plate as defined in claim 5 wherein one of said rims includes a slot extending generally along a chord to the outer circumference of said body member and having a closed inner end, said slot being circumferentially spaced from said cutting blade to permit said advancing yarn to be engaged by said slot and deposited into said groove during rotation of said clamping plate.

7. The clamping plate as defined in claim 6 wherein one of said rims is opposite said one inner surface mounting said cutting blade means and includes a recess in its inner surface, said recess being laterally aligned with said cutting edge means to define a pair of guide edges on respective opposite sides of said cutting edge means, said guide edges being parallel to and spaced from said cutting edge means, said cutting edge means having an outer edge portion which extends into said recess so that the yarn is deflected laterally from its advancing direction by contact with said guide edges and said cutting edge.

8. The clamping plate as defined in claim 7 wherein said recess is in the form of a slot which extends completely through said opposite rim.

* * * * *

UNITED STATES PATENT AND TRADEMARK OFFICE

CERTIFICATE OF CORRECTION

PATENT NO. : 5,158,241

DATED : October 27, 1992

INVENTOR(S) : Peter Dammann, et al.

It is certified that error appears in the above-indentified patent and that said Letters Patent is hereby corrected as shown below:

Column 6, line 42, delete "other" and insert --path--.

Signed and Sealed this

Nineteenth Day of October, 1993

*Attest:*

*Attesting Officer*

BRUCE LEHMAN

*Commissioner of Patents and Trademarks*